US007831171B2

(12) United States Patent
Holmes et al.

(10) Patent No.: US 7,831,171 B2
(45) Date of Patent: Nov. 9, 2010

(54) DEVICE AND METHOD FOR REMANUFACTURING PRINTER CARTRIDGES

(75) Inventors: Denny Holmes, Los Angeles, CA (US); Craig Rummler, Northridge, CA (US)

(73) Assignee: Mitsubishi Kagaku Imaging Corporation, San Fernando, CA (US)

( * ) Notice: Subject to any disclaimer, the term of this patent is extended or adjusted under 35 U.S.C. 154(b) by 363 days.

(21) Appl. No.: 12/079,842

(22) Filed: Mar. 27, 2008

(65) Prior Publication Data

US 2009/0245856 A1 Oct. 1, 2009

(51) Int. Cl.
*G03G 15/00* (2006.01)

(52) U.S. Cl. ..... 399/109; 399/113

(58) Field of Classification Search ..... 399/107, 399/109, 119, 120, 262, 113
See application file for complete search history.

(56) References Cited

U.S. PATENT DOCUMENTS 5,937,238 A * 8/1999 Tremblay et al. ..... 399/109
6,240,605 B1 * 6/2001 Stevens et al. ..... 24/546
6,754,460 B2 * 6/2004 Lewis et al. ..... 399/109
6,952,544 B2 * 10/2005 Kikuchi et al. ..... 399/109

FOREIGN PATENT DOCUMENTS

DE 19936459 A1 * 3/2001
JP 09319198 A * 12/1997
JP 2002268514 A * 9/2002
JP 2002268516 A * 9/2002

* cited by examiner

*Primary Examiner*—Robert Beatty

(57) ABSTRACT

A printer cartridge fastener comprising a curved portion adapted to grasp a printer cartridge overhang; a main body connected to the curved portion, the main body comprising a first side connected to the curved section; and a second side positioned opposite the first side; and an elongate portion connected to the second side of the main body, the elongate portion configured to abut to a printer cartridge portion positioned substantially perpendicular to the overhang.

20 Claims, 5 Drawing Sheets

DEVICE AND METHOD FOR REMANUFACTURING PRINTER CARTRIDGES

CROSS REFERENCES TO RELATED APPLICATIONS

None

FIELD OF INVENTION

The present invention relates to electrophotography, particularly methods and apparatus for manufacturing or remanufacturing toner cartridges.

BACKGROUND

Used printer cartridges are often remanufactured. The process of remanufacturing a printer cartridge may include cleaning the cartridge, repairing damaged parts, replacing worn parts, or replenishing the cartridge with toner. The toner in the cartridge is typically stored in the cartridge's toner hopper, which has a toner hopper opening. During remanufacturing, it is desirable to have full access to the toner hopper opening in order to remove any remaining traces of old seals, dump the old toner, completely clean the interior of the toner hopper, replenish it with new toner, and seal the toner hopper opening with a new seal.

Some toner hopper openings of some cartridges, such as cartridges for use with Hewlett Packard Company's HP4200 printers, are blocked by their respective developer or mag roller housing. The developer roller housing is typically ultrasonically welded around the toner hopper opening. To gain access to the toner hopper opening during the remanufacturing process, the developer roller housing is usually detached from the toner hopper by breaking the ultrasonic welds thereby splitting the cartridge into two sections-namely, the toner hopper section and the developer roller housing section. The splitting process may involve using conventional tools, such as blades, screw drivers, and rotary tools, in combination with force to cut or break the ultrasonic or plastic welds.

After all the worn or damaged parts have been replaced or repaired and the toner has been replenished, the cartridge is usually re-assembled. Re-attaching the developer roller housing and the toner hopper by ultrasonic welding may not be cost effective to many remanufacturers. Cost effective methods and devices for re-attaching the developer roller housing with the toner hopper during remanufacturing are desired and are addressed by the present invention.

BRIEF DESCRIPTION

The invention includes a printer cartridge fastener comprising a curved portion adapted to grasp a printer cartridge overhang; a main body connected to the curved portion, the main body comprising a first side connected to the curved section; and a second side positioned opposite the first side; and an elongate portion connected to the second side of the main body, the elongate portion configured to abut to a printer cartridge portion positioned substantially perpendicular to the overhang.

The above description sets forth, rather broadly, a summary of embodiments of the present invention so that the detailed description that follows may be better understood and contributions of the present invention to the art may be better appreciated. Some of the embodiments of the present invention may not include all of the features or characteristics listed in the above summary. There may be, of course, other features of the invention that will be described below and may form the subject matter of claims. In this respect, before explaining at least one embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways.

DESCRIPTION OF THE PREFERRED EMBODIMENTS

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. Also, it is to be understood that the phraseology and terminology employed herein are for the purpose of description and should not be regarded as limiting.

Figure 1:
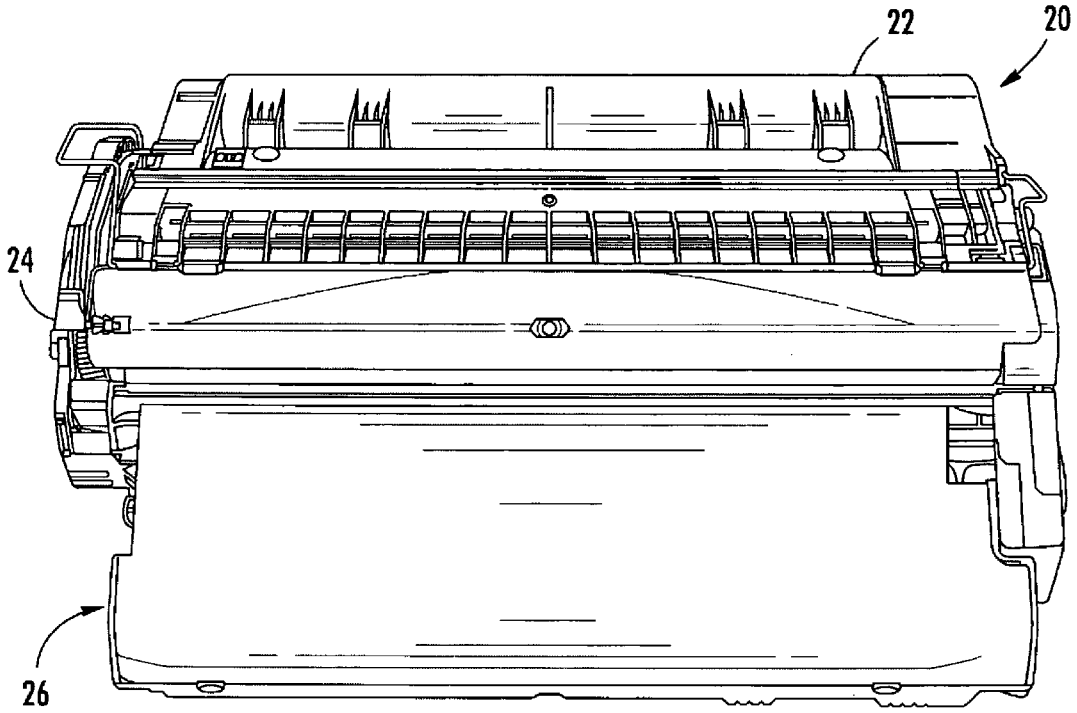
FIG. 1 PRIOR ART
FIG. 1 is substantially a plan view of an existing printer cartridge for which the device and printer remanufacturing method of the present invention may be applied.

Referring to FIG. 1, printer cartridge 20, such as the cartridge for Hewlett Packard's HP4200 printer, may have a toner hopper 22 where toner (not shown) is stored. The toner hopper 22 may have a toner hopper opening (not shown) that allows the toner to be discharged to the other parts of the cartridge and eventually to the paper. The cartridge 20 may also have a developer roller housing 24, which is attached to the toner hopper 22 and which contains the developer roller (not shown). The developer roller is typically a cylindrical roller that acquires toner on its surface and uniformly charges the toner deposited on its surface. The developer roller transfers the toner to an organic photoconductor drum (not shown), which carries the image to be printed to a piece of paper. The developer roller may sometimes be referred to as a "mag roller" in the industry.

The printer cartridge 20 may also have a waste hopper 26 attached to the developer roller housing 24. The waste hopper 26 stores the excess toner removed from the drum after the image has been printed on a paper. Excess toner is typically removed from the drum and discarded in the waste hopper 26 to provide a clean print without unwanted print. Old toner may be removed off the toner hopper 22 by blowing air through the toner hopper opening. Traces of old seal or seal adhesive may be removed from the surfaces surrounding the toner hopper opening. New toner may be added through the toner hopper opening, and a new seal may be installed to cover the toner hopper opening. After the desired cartridge remanufacturing steps have been performed, the developer roller housing 24 may be attached to the toner hopper 22 using the methods and device of the present invention.

Figure 2:
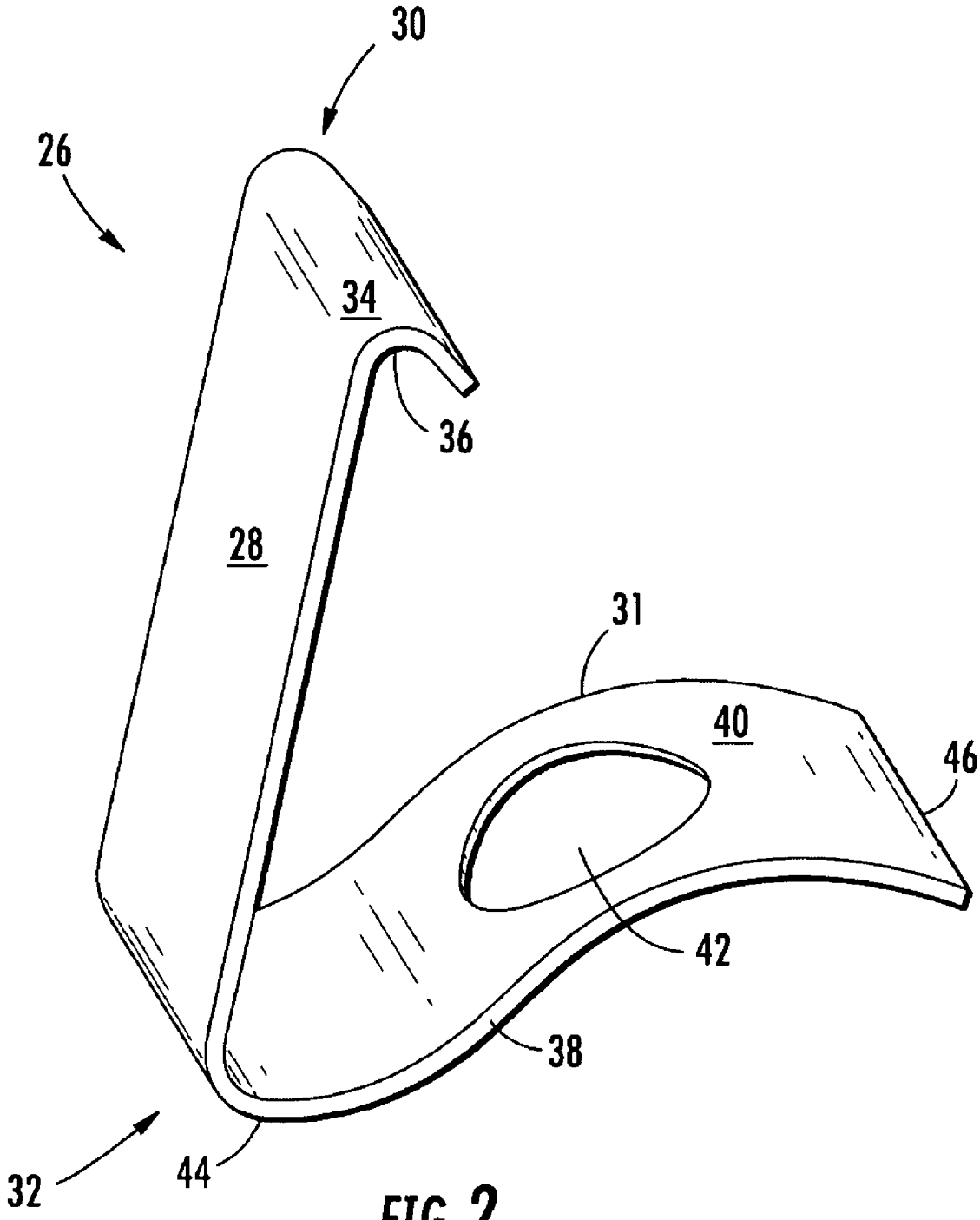
FIG. 2 is substantially a perspective view of a fastening device of the present invention.

Referring to FIG. 2, the present invention includes a fastener 26, which preferably includes a main body 28. The main body 28 may be substantially flexible, substantially flat, and substantially rectangular in shape. Of course, the shape of the main body 28 may vary. The main body 28 preferably includes a middle portion 31 two opposing sides 30 and 32. First side 30 is preferably connected to a curved portion 34, which may be C-shaped and may resemble a hook. The curved portion 34 preferably extends towards the underside 36 of the fastener 26.

The fastener 26 preferably also includes an elongate portion 38, which preferably extends from the second side 32 of the main body 28. In the preferred embodiment, the elongate portion 38 preferably defines a curved surface 40 and recess 42 substantially in between a proximal end 44 and a distal end 46 of the elongate portion 38. The curved surface 40 preferably curves towards the middle portion 31 and is preferably configured to abut to a portion of the toner hopper. The recess 42 may be shaped as round, oblong, or any other shapes that would accommodate a toner hopper protrusion, as further described. The recess 42 may be eliminated for instance if the remanufacturing method of choice is to cut the toner hopper protrusion. In other embodiments (not shown), the elongate portion 38 may be a straight or bent piece of material. In the preferred embodiment, the main body 28, the elongate portion 38, and the curved portion 34 are of equal width. Of course, the widths of the main body 28, the elongate portion 38, and the curved portion 34 can vary. The fastener 26 may be made of commonly known materials, such as metal, and may be made of commonly known methods, such as stamping and bending.

Figure 3:
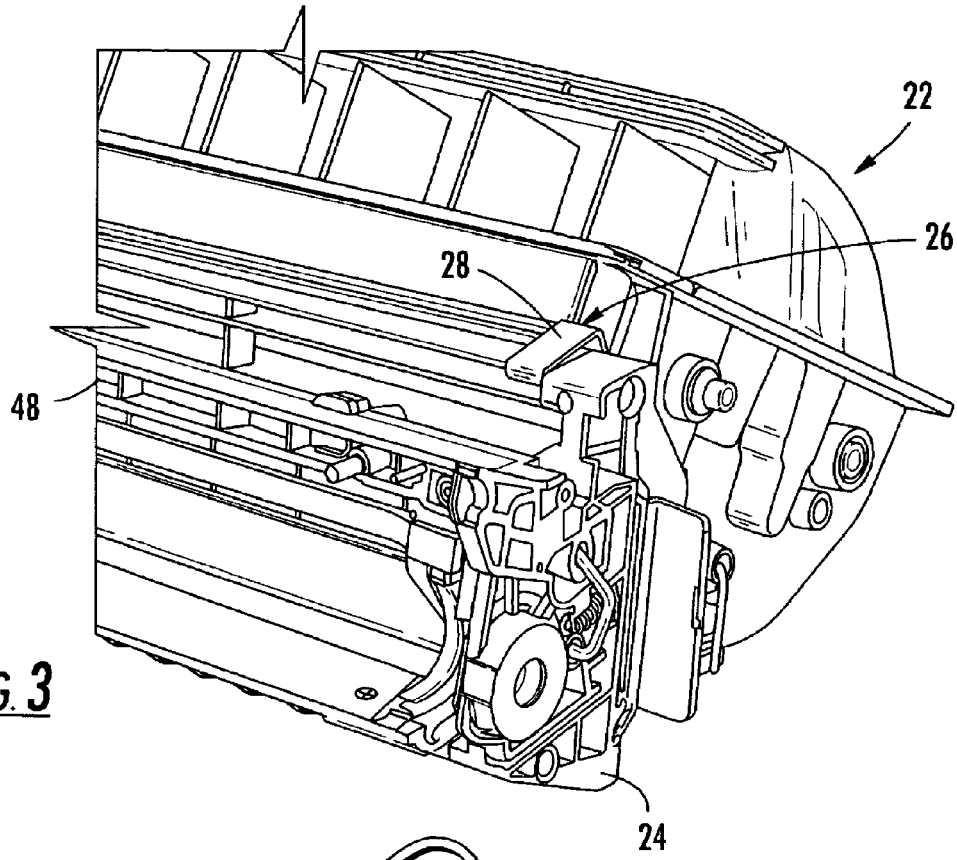
FIG. 3 is substantially a perspective view of the fastening device shown in FIG. 2 being used in the remanufacturing of the printer cartridge of FIG. 1.

In use, a developer roller housing 24 is preferably positioned next to a toner hopper 22 (FIG. 3). Fastener 26 is preferably used to join the developer roller housing 24 with the toner hopper 22 by inserting the curved portion 34 of the fastener through a developer roller housing slot 48. The main body 28 of the fastener 26 is preferably positioned such that it spans across a portion of the developer roller housing 24 and a portion of the toner hopper 22. The elongate portion 38 of the fastener 26 is preferably positioned proximate to the toner hopper 22. It can be realized that the curved portion 34 and the elongate portion 38 of the fastener exert opposing pressures that aid in joining the developer roller housing 24 with the toner hopper 22.

Figure 4:
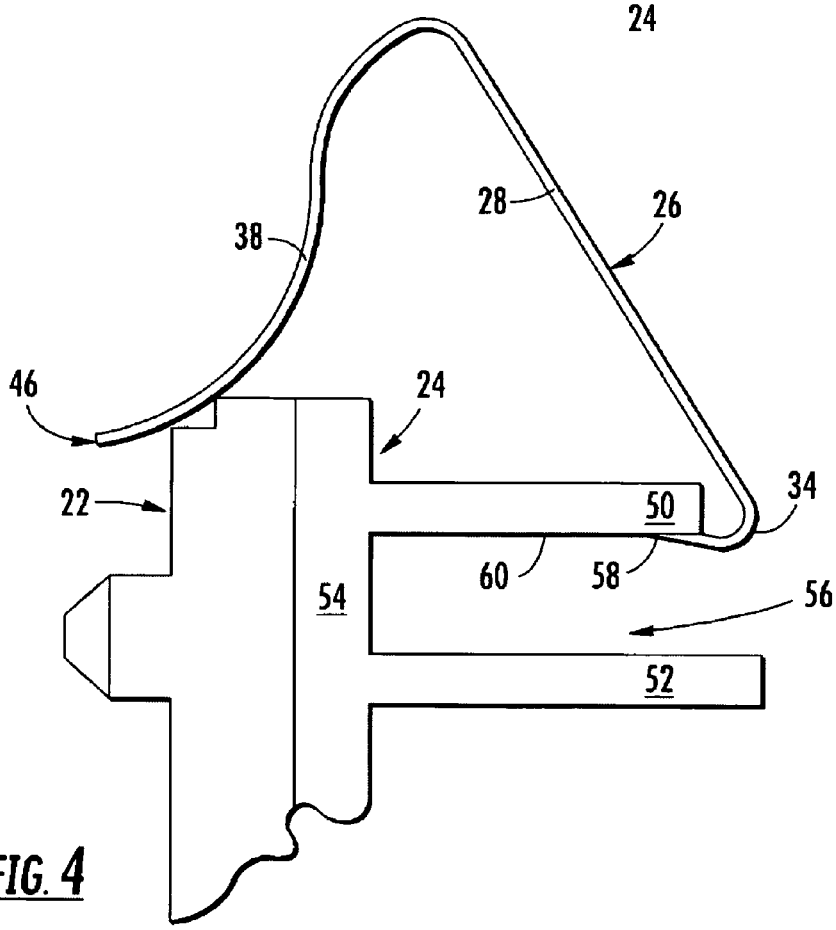
FIG. 4 is substantially a side view of the fastening device of FIG. 2 being positioned on a printer cartridge.

Referring now to FIG. 4, developer roller housing 24 may define at least two overhangs 50 and 52 that protrude from a developer roller housing wall 54. The overhangs 50 and 52 define a developer roller housing slot 56 where curved portion 34 of the fastener 26 may be inserted. Curved portion end 58 of the fastener 26 may abut the underside 60 of overhang 50. Opposite the curved portion end 58, the elongate portion 38 of the fastener 26 is preferably stretched to allow its distal end 46 to be positioned above a portion of the toner hopper 22.

Figure 5:
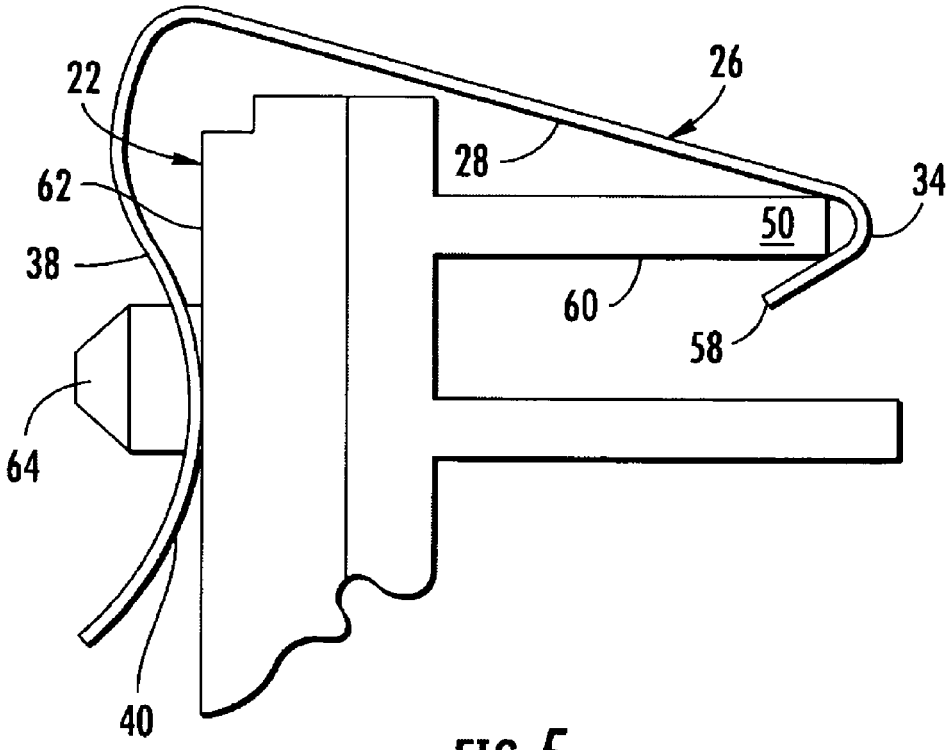
FIG. 5 is substantially a side view of the fastening device of FIG. 2 being positioned on a printer cartridge.

Referring now to FIG. 5, the main body 28 of the fastener 26 is preferably pushed down until the main body 28 is proximately positioned to the top surfaces of the developer roller housing 24 and the toner hopper 22. The main body 28 preferably lies on the top surfaces of the developer roller housing 24 and the toner hopper 22 in a slanted manner. Curved surface 40 of the elongate portion 38 preferably contacts in part the wall 62 of the toner hopper 22. It can be realized that as curved surface 40 presses on wall 62, curved portion 34 may press on overhang 52 thereby joining the developer roller housing 24 and the toner hopper 22 together. If the toner wall 62 includes a protrusion 64, the protrusion may be accommodated by recess 42 (FIG. 3) defined by the curved surface 40 of the fastener 26. It can be appreciated that by surrounding the protrusion 64 with the elongate portion 38 of the fastener 26, the fastener 26 may be secured from movements, such as sliding or lateral movements, that may loosen the attachment of the developer roller housing 24 to the toner hopper 22.

Figure 6:
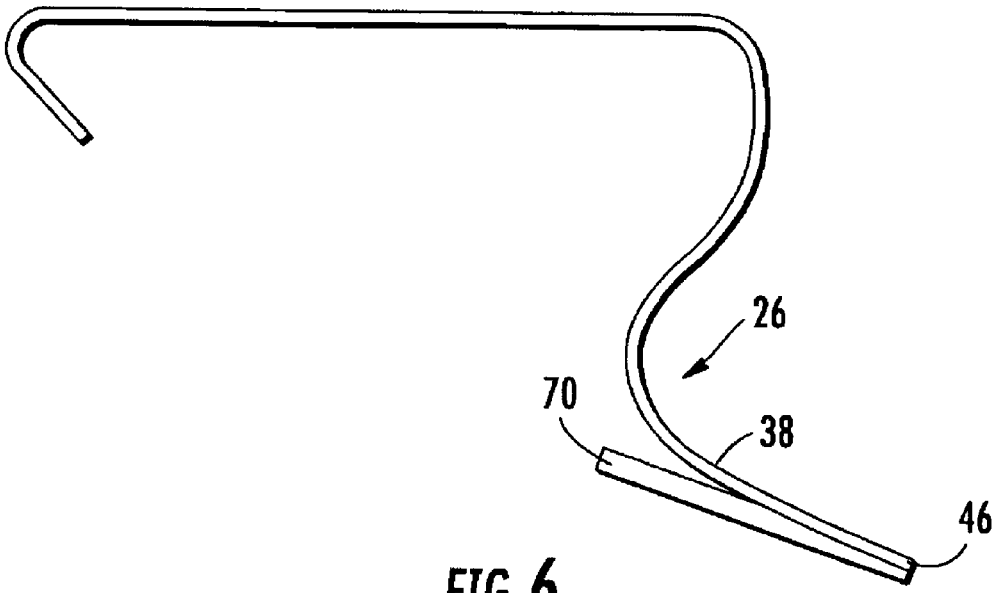
FIG. 6 is substantially a side view of another fastening device embodiment of the present invention.
Figure 7:
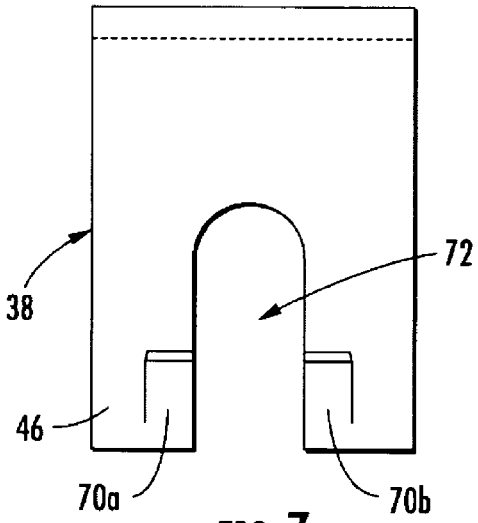
FIG. 7 is substantially a front view of the elongate portion of the fastening device embodiment of FIG. 6.
Figure 8:
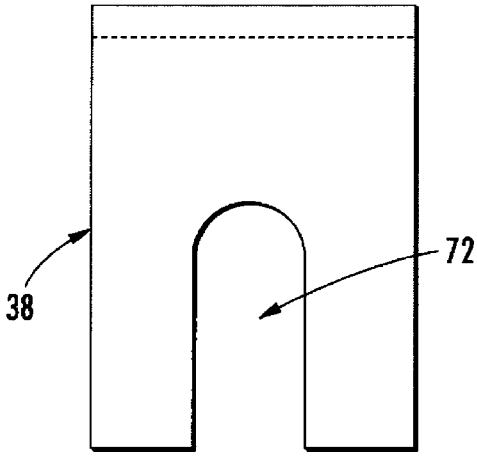
FIG. 8 is substantially a front view of the elongate portion of yet another embodiment of the fastening device of the present invention.

Referring now to FIGS. 6-8, various embodiments of the fastener 26 are shown. In FIG. 6, fastener 26 preferably includes a plurality of barbs 70 attached at the distal end 46 of the elongate portion 38. Barbs 70 are preferably attached in an inclined position to the distal end of the elongate portion 38 that faces towards the curved portion 34. When used, barbs 70 are preferably configured to penetrate through a cartridge portion, such as a toner hopper wall, to prevent detachment of the elongate portion 38 of the fastener 26 from the cartridge. In FIG. 7, another fastener embodiment may include barbs 70*a* and 70*b* attached side by side to the distal end 46 of the elongate portion 38 of the fastener. The elongate portion 38 of the fastener embodiment preferably defines a U-shaped slot 72 in lieu of the recess 42. The U-shaped slot 72 is preferably configured to accommodate a cartridge protrusion, such as protrusion 64 (FIGS. 4 and 5), and to substantially minimize fastener movement and detachment from the cartridge. Of course, the slot may have different shapes and still falls within the scope of the invention. Barbs 70*a* and 70*b* are preferably attached to the distal end 46 of the elongate portion 38 at a position wherein slot 72 is in between barbs 70*a* and 70*b*. In FIG. 8, another embodiment of the fastener preferably resembles the fastener embodiment shown in FIG. 7 except that the barbs 70*a* and 70*b* are eliminated. The fastener embodiment includes an elongate portion 38 that defines a slot 72 configured to accommodate a cartridge protrusion (not shown).

Figure 9:
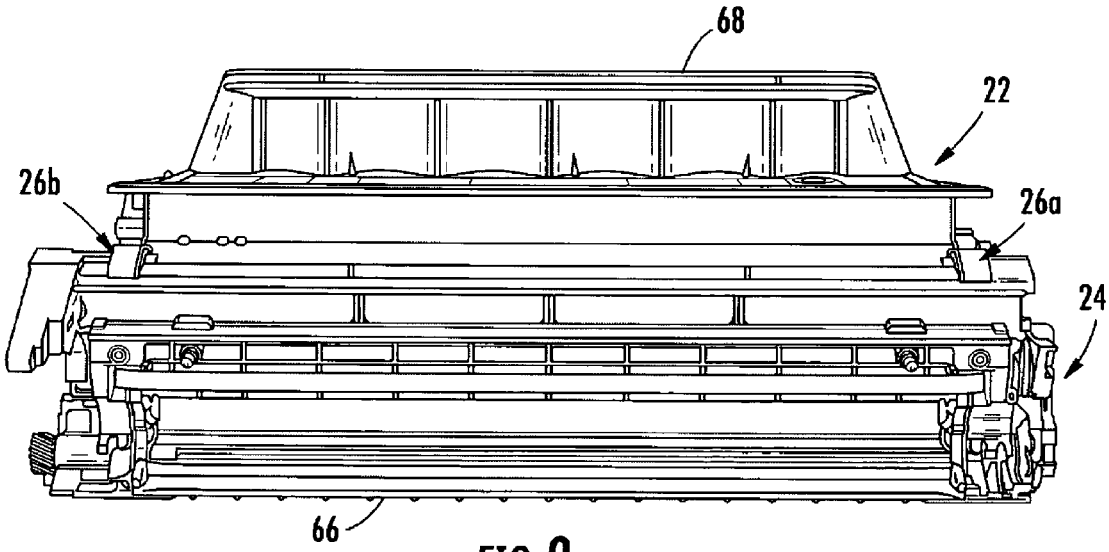
FIG. 9 is substantially a front view of the printer cartridge of FIG. 1 with the waste hopper removed and with the multiple fastening devices being used to attach the developer roller housing with the toner hopper.

Referring now to FIG. 9, multiple fasteners 26 may be used to attach the developer roller housing 24 to the toner hopper 22. For instance, one fastener 26*a* may be used to attach the developer roller housing 24 to the toner hopper 22 at a first corner, and another fastener 26*b* may be used at a second corner. Adhesive tapes (not shown) may be used to further support the attachment of the developer roller housing 24 to the toner hopper 22. The adhesive tapes may be positioned along the developer roller housing rail 66 and the toner hopper rail 68.

It can be appreciated that the present invention provides an alternative to ultrasonically welding back cartridge pieces during remanufacturing. The present invention provides an alternative that is more cost effective than ultrasonic welding and that allows cartridges to be remanufactured faster and with less tooling involved. Although the description above contains many specifications, these should not be construed as limiting the scope of the invention but as merely providing illustrations of some of the presently preferred embodiments of this invention. For example, the shapes of the fastener main body 28 and elongate portion 38 may vary. The fastener may be used to join printer cartridge parts other than the developer roller housing and the toner hopper. The invention is capable of other embodiments and of being practiced and carried out in various ways. The invention is not limited in its application to the details of the construction and to the arrangement of the components set forth in the above description or as illustrated in the drawings.

What is claimed is:

1. A printer cartridge comprising:

a. a toner hopper configured to store toner;

b. a developer roller housing configured to contain a developer roller; and c. at least one fastener attaching the developer roller housing to the toner hopper, the fastener comprising:

i. a fastener body comprising a first side and a second side, the second side being opposite the first side, wherein when the fastener attaches the developer roller housing to the toner hopper, the fastener body is positioned in a slanted manner across a top surface of a developer roller housing wall and a top surface of the toner hopper, such that the fastener body does not contact the top surfaces of the developer roller housing wall and the toner hopper;

ii. a curved section attached to the first side of the fastener body, the curved section being configured to hook a portion of the developer roller housing; and iii. an elongate portion attached to the second side of the fastener body and extending from the second side, the elongate portion having a round recess through the elongate portion to accommodate a toner hopper protrusion that can be inserted through the elongate portion, such that surrounding the toner hopper protrusion with the round recess of the elongate portion secures the fastener from movement.

2. The printer cartridge of claim 1, wherein the developer roller housing comprises the developer roller housing wall and a plurality of overhangs attached to the developer roller housing wall, the developer roller housing wall and the plurality of overhangs defining a slot, and wherein the curved section of the fastener is configured to be positioned within the slot.

3. The printer cartridge of claim 1, wherein the fastener body overlies a portion of the developer roller housing and a portion of the toner hopper.

4. The printer cartridge of claim 1, wherein the fastener is attached at a first end of the developer roller housing and the toner hopper, the printer cartridge further comprising a second fastener attached to a second end of the developer roller housing and the toner hopper, the second end being positioned opposite to the first end.

5. The printer cartridge of claim 1, wherein the toner hopper has previously been used.

6. The printer cartridge of claim 1, wherein surrounding the toner hopper protrusion with the round recess of the elongate portion substantially prevents lateral movements of the fastener that may loosen the attachment of the developer roller housing to the toner hopper.

7. A printer cartridge fastener comprising:

a. a curved portion adapted to grasp a printer cartridge overhang;

b. a main body connected to the curved portion, the main body comprising:

i. a first side connected to the curved section; and ii. a second side positioned opposite the first side;

wherein when the printer cartridge fastener attaches a developer roller housing of the printer cartridge to a toner hopper of the printer cartridge, the main body is positioned in a slanted manner across a top surface of a developer roller housing wall and a top surface of the toner hopper, such that the main body does not contact the top surfaces of the developer roller housing wall and the toner hopper, and c. an elongate portion connected to the second side of the main body, the elongate portion having a round recess through the elongate portion to accommodate a toner hopper protrusion of a printer cartridge that is inserted through the elongate portion, such that surrounding the toner hopper protrusion with the round recess of the elongate portion secures the fastener from movement.

8. The printer cartridge fastener of claim 7, wherein the elongate portion exerts pressure on the printer cartridge portion in a direction that is towards the overhang.

9. The printer cartridge fastener of claim 7, wherein the overhang is part of a developer roller housing.

10. The printer cartridge fastener of claim 7, wherein the printer cartridge portion is part of a toner hopper.

11. The printer cartridge fastener of claim 7, wherein the curved portion is adapted to grasp an overhang from a developer roller housing and the elongate portion is adapted to abut to a toner hopper portion.

12. The printer cartridge fastener of claim 7, wherein surrounding the toner hopper protrusion with the round recess of the elongate portion substantially prevents lateral movements of the fastener.

13. The printer cartridge fastener of claim 7, wherein the first side of the main body is adapted to be positioned proximate to a developer roller housing and the second side of the main body is adapted to be positioned proximate to a toner hopper.

14. The printer cartridge fastener of claim 7, wherein the main body, the elongate portion, and the curved portion each comprises a width, the respective widths being equal.

15. The printer cartridge fastener of claim 7, wherein the main body comprises a middle portion, the elongate portion comprising a curved surface being towards the middle portion, the curved surface adapted to abut to a portion of a toner hopper.

16. A fastener for attaching a developer roller housing of a printer cartridge to a toner hopper of the printer cartridge, the printer cartridge comprising an overhang portion and a wall portion positioned substantially perpendicular to the overhang portion, the fastener comprising:

a. curved portion for engaging the printer cartridge overhang portion;

b. an elongate portion for pressing the wall portion towards the overhang, the elongate portion having a round recess through the elongate portion to accommodate a toner hopper protrusion that can be inserted through the elongate portion, such that surrounding the toner hopper protrusion with the round recess of the elongate portion secures the fastener from movement; and c. a main body for joining the curved portion and the elongate portion, wherein when the fastener attaches the developer roller housing to the toner hopper, the main body is positioned in a slanted manner across a top surface of a developer roller housing wall and a top surface of the toner hopper, such that the main body does not contact the top surfaces of the developer roller housing wall and the toner hopper.

17. The fastener of claim 16, wherein the elongate portion comprises an abutting surface and an exterior surface positioned opposite to the abutting surface, the abutting surface being configured to abut to the wall portion of the printer cartridge.

18. The fastener of claim 17, wherein the abutting surface is curved.

19. The fastener of claim 16, wherein surrounding the toner hopper protrusion with the round recess of the elongate portion substantially prevents lateral movements of the fastener that may loosen the attachment of the developer roller housing to the toner hopper.

20. The fastener of claim 16, wherein the curved portion, elongate portion, and main body each comprises a width, the widths of the curved portion, elongate portion, and main body being equal to each other.

* * * * *